United States Patent [19]

Tamra

[11] Patent Number: 4,593,729

[45] Date of Patent: Jun. 10, 1986

[54] FUEL DISPENSING NOZZLE WITH AUTOMATIC SHUT-OFF VALVE

[76] Inventor: Shigenori Tamra, 4-2, Mukougaoka 2-chome, Bunkyo-ku, Tokyo, 113, Japan

[21] Appl. No.: 662,620

[22] Filed: Oct. 19, 1984

[30] Foreign Application Priority Data

Apr. 11, 1984 [JP] Japan ..... 59-72287

[51] Int. Cl.[4] ..... B65B 3/18

[52] U.S. Cl. ..... 141/218; 141/392

[58] Field of Search ..... 141/98, 302, 1, 392, 141/59, 198, 206–229, 285, 290, 301; 137/68 R, 797

[56] References Cited

U.S. PATENT DOCUMENTS

| | | | |
|---|---|---|---|
| 3,273,609 | 9/1966 | Carder et al. | 141/206 |
| 3,521,680 | 7/1970 | Wood et al. | 141/218 |
| 3,653,415 | 4/1972 | Boudot et al. | 141/208 |
| 3,866,636 | 2/1975 | Lasater | 141/392 |
| 3,900,056 | 8/1975 | Giardini et al. | 141/392 |
| 3,938,565 | 2/1976 | Robinson et al. | 141/392 |
| 3,996,977 | 12/1976 | Hansel | 141/392 |
| 4,196,759 | 4/1980 | McMath et al. | 141/392 |
| 4,265,281 | 5/1981 | Oberrecht | 141/218 |
| 4,351,375 | 9/1982 | Polson | 141/392 |

FOREIGN PATENT DOCUMENTS 49-12218 3/1974 Japan .

*Primary Examiner*—Houston S. Bell, Jr.

*Attorney, Agent, or Firm*—Oblon, Fisher, Spivak, McClelland & Maier

[57] ABSTRACT

A slide rack is pivotally supported at one end thereof on a plunger coaxially with an operating lever. On the other hand, a trigger which is urged in a direction away from the slide rack by a release spring has one end thereof pivotally supported on an intermediate portion of the operating lever, and the other end of the trigger is releasably engageable with a rack portion of the slide rack.

For automatic shut-off fuel supply, the operating lever is pulled up and the fore end of the trigger is held in a rack portion of the slide rack to maintain a valve open position. As soon as a fuel tank is filled, the plunger is slided downward, whereupon one end of the slide rack is shifted downward with the other end slided along a lever guard. By this sliding movement, the trigger is released from the rack portion of the slide rack to return the operating lever automatically into a valve closing position.

6 Claims, 4 Drawing Figures

FUEL DISPENSING NOZZLE WITH AUTOMATIC SHUT-OFF VALVE

BACKGROUND OF THE INVENTION

1. Field of the Invention

This invention relates to an automatic shut-off type fuel dispensing nozzle with an automatic valve closing mechanism which is adapted to close a valve automatically when a liquid in a container, which is being replenished, reaches a predetermined level.

2. Description of the Prior Art

Generally, the automatic shut-off fuel dispensing nozzles of this sort incorporate, in the vicinity of a fuel inlet end of a nozzle body, a hook which is provided with a plural number of grooves to serve as means for holding an operating lever in a valve open position at the time of an automatic shut-off fuel dispensing operation, in which the operating lever is pulled about a pivotal point at its pivotal connection to a plunger thereby pushing up a valve stem to open the valve and engaging an end portion of the operating lever with a groove of the hook. However, the fuel dispensing nozzles of this type have a drawback that, due to a large distance between the pivoting point of the operating lever and its hook engaging position, the operating lever is easily disengaged from the hook even when slight vibration is applied to the nozzle body or operating lever, automatically closing the valve before the liquid in the container reaches the predetermined level.

In order to eliminate the above-mentioned drawback, there have thus far been proposed various automatic shut-off nozzles including, for example, Japanese Patent Publication No. 49-12218 which discloses an arrangement including, as means for retaining the operating lever in valve open position, a lower lever pivotally supported for movement about a first pivotal point at a connection to a plunger to push up a valve stem, an upper lever having one end thereof pivotally supported for movement about a second pivotal point at the other end of the lower lever, with a valve stem passed therethrough by way of a guide plate or guide rollers, and forming a handle for operating the other end, a trigger pivotally supported for movement about the second pivotal point for maintaining the valve open position, and a rack mounted on a lever guard for holding the fore end of the trigger, the lower and upper levers constituting an operating lever.

At the time of the valve opening operation, the lower and upper levers are turned about the first pivotal point and the trigger is engaged with the rack to maintain the valve open position. As soon as the liquid in the container reaches a predetermined level, a diaphragm is moved to release the plunger from engagement with latch means consisting of a latch pin and balls, opening the valve body and pushing the valve stem by a valve spring thereby to cause the lower lever alone to turn counterclockwise about the second pivotal point and to disengage the trigger from the rack.

With the above-described prior art nozzle construction, the trigger is engaged with the rack on the lever guard in such a manner that the trigger is stuck against a notch or a stepped portion of the rack, holding the valve stem securely in the valve open position. For closing the valve, the lower lever is turned counterclockwise through the valve stem by the action of a valve spring which urges a valve body in a valve closing direction. In association with this operation, the trigger is released in a secure and reliable manner.

However, the above-described prior art construction has a number of drawbacks as follows.

(1) The operating lever which consists of lower and upper levers is adapted to retain the valve open position by abuttingly engaging the trigger against a notch or stepped portion of the rack, ensuring secure engagement with the rack. However, since the rack is fixedly secured on the inner surface of the lever guard and the fore end of the trigger is forcibly held in frictional engagement with a notch or stepped portion of the rack, there sometimes occurs a trouble that the trigger fails to disengage from the rack even after the lower lever is turned counterclockwise about the second pivotal point due to the replenished liquid in a fuel tank reaching a predetermined level.

(2) The operating lever is basically constituted by two members, namely, a lower lever and an upper lever which is pivotally supported by the lower lever, so that it requires an increased number of parts including a connecting pin and a rivet, lowering the efficiency of machining and assembling operations.

(3) The rack which is formed with notches or steps is fixedly mounted on the inner surface of the lever guard. That is to say, it is necessary to provide a rack separately and mount it on the lever guard by the use of rivets. This arrangement similarly lowers the efficiency in machining and assembling operations.

(4) The valve stem is passed through the upper lever in contact with a guide plate or guide rollers which are provided on the upper lever, and abuttingly engageable with the bottom surface of a channel on the lower lever to push and turn the lower lever about the second pivotal point. Therefore, it is necessary to provide on the upper lever a guide plate which slidably receives the valve stem or a pair of guide rollers which grippingly guide the valve stem, inviting a further increase in the number of parts in addition to the abovementioned drawbacks.

SUMMARY OF THE INVENTION

It is therefore an object of the present invention to provide an automatic shut-off fuel dispensing nozzle which can securely release the fore end portion of a trigger from a rack portion of a slide rack at the time of the automatic shut-off operation.

It is another object of the invention to provide an automatic shut-off fuel dispensing nozzle which requires a reduced number of parts and which is improved in the efficiency of machining and assembling operations.

In order to achieve the foregoing objectives, the present invention provides an automatic fuel dispensing nozzle, comprising: a nozzle body internally defining a fuel passage and having a spout tube at the outlet end of the fuel passage; a valve body liftably seated on a valve seat in the nozzle body for opening and closing the fuel passage; a valve spring for urging the valve body in a closing direction; a valve stem having one end thereof connected to the valve body and the other end protruded out of the nozzle body; a plunger slidably fitted in the nozzle body; a partition member movable when the liquid from the spout nozzle reaches a predetermined level; an engaging means for engaging one end of said plunger with said partition member until said predetermined liquid level is reached to hold said plunger in a first position and breaking said engagement to permit said plunger to slide into a second position when said partition member is moved; an operating lever having one end thereof pivotally supported on the other end of said plunger, being abutted at an intermediate portion thereof against the other end of said valve stem, and forming a handle at the other end; a lever guard secured to said nozzle body in a manner to circumvent said operating lever; a slide rack having one end thereof pivotally supported on the other end of said plunger and the other end slidably supported on the inner surface of said lever guard, and provided with a rack portion at the other end; and a trigger pivotally supported on an intermediate portion of said operating lever and releasably engageable with the rack portion of the slide rack.

BRIEF DESCRIPTION OF THE DRAWINGS

The above and other objects, features and advantages of the invention will become apparent from the following description and appended claims, taken in conjunction with the accompanying drawings in which:

DESCRIPTION OF PREFERRED EMBODIMENTS

Figure 1:
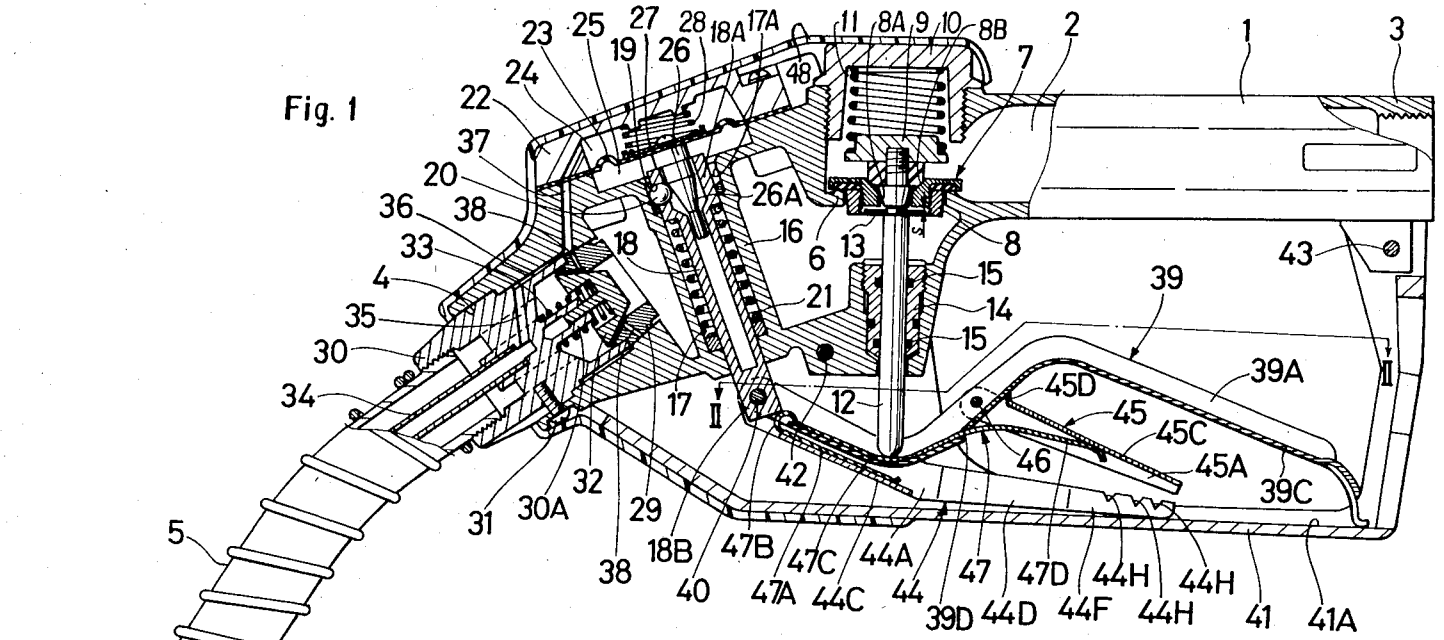
FIG. 1 is a schematic longitudinal section of an automatic shut-off type fuel dispensing nozzle according to the invention.
Figure 2:
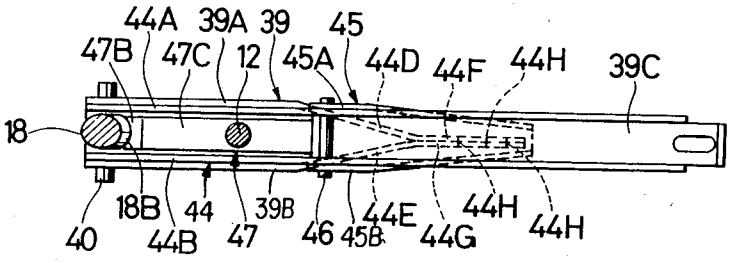
FIG. 2 is a schematic sectional view taken on line II—II of FIG. 1, showing an operating lever, slide rack, trigger and a leaf spring.

Referring to FIGS. 1 and 2, designated at 1 is a nozzle body which is internally provided with a fuel passage 2 having an inlet 3 at one end thereof connected to a hose from a fuel metering machine through a joint (not shown). The other end of the fuel passage 2 forms an outlet 4 which is connected to a spout tube 5 through a spout connector 30 which will be described later. The distal end 5A of the spout tube 5 opens to the outside and is inserted into a fuel tank of a vehicle for fuel replenishment.

Denoted at 6 is a valve seat which is formed in the nozzle body 1 across the fuel passage 2, on which a valve body 7 is liftably seated. In the particular embodiment shown, the valve body 7 is constituted by a main valve body 8 to be disengageably seated directly on the valve seat 6, and an auxiliary valve body 9 to be seated and unseated relatively to the main valve body 8. The main valve body 8 is provided with an opening 8A serving as a fuel supply port and receiving a valve stem therein, and a valve seat portion 8B on which the auxiliary valve body 9 is disengageably seated. Indicated at 10 is a cap which is threaded into the nozzle body 1 at a position over the valve body 7. A valve spring 11 is charged between the cap 10 and auxiliary valve body 9 to urge the valve body 7 in the closing direction.

The reference numeral 12 indicates a valve stem which is operated for opening and closing the valve body 7, the valve stem having one end thereof extended through the fuel supply port 8A of the main valve body 8 and secured to the auxiliary valve body 9 and the other end extended through the nozzle body 1 toward a lever guard 41 which will be described later. A washer 13 is mounted at one end of the valve stem 12 for opening and closing the main valve body 8. The washer 13 is spaced from the main valve body 8 by a small gap S when the auxiliary valve body 9 is seated on the main valve body 8, so that the auxiliary valve body 9 is opened in advance. The valve stem 12 is inserted and supported in a sleeve 14 of, for example, brass which is secured to the nozzle body 1 through a plural number of O-rings 15 to provide a fluid tight seal between the sleeve 14 and valve stem 12.

Denoted at 16 is a cylindrical wall which is extended vertically in the drawing at a position between the valve seat 6 and the fuel outlet 4, and internally provided with a plunger receiving bore 17 with a stepped large diameter portion 17A in the upper portion thereof. Slidably fitted in the bore 17 is a hollow plunger 18 with a closed bottom end and an upper end portion 18A of a larger diameter which is positioned in the stepped large diameter portion 17 of the bore 17. The lower end of the plunger 18 is protruded downward of the nozzle body 1, forming a plunger connecting portion 18B. The large diameter portion 18A of the plunger 18 is provided with ball fitting holes 19 at three positions at an interval of 120° in the circumferential direction for receiving balls 20 (only one of which is shown in FIG. 1). The balls 20 retain the plunger 18 in the first position shown in cooperation with a latch pin 26 which will be described hereinlater. Indicated at 21 is a plunger return spring consisting of a compression spring which is located within the plunger fitting bore 17 between the plunger 18 and the bottom wall of the cylindrical portion 16. The spring 21 has a function of returning the plunger 18 to the first position of FIG. 1 from a second position to which the plunger 18 is slidingly displaced in the manner as will be described later.

The reference numeral 22 denotes a cap which is securely fixed to the nozzle body 1 on the upper side of the plunger 18. A diaphragm 23 which serves as a partition member is gripped between the cap 22 and nozzle body 1, partitioning the space between the cap 22 and the nozzle body 1 into a vacuum chamber 24 and an atmospheric chamber 25. Indicated at 26 is a latch pin which is securely fixed to the diaphragm 23 along with a spring seat 27, the latch pin 26 being provided with a tapered surface 26A which is fitted in the large diameter portion 18A of the plunger 18. A compression spring 28 is charged between the cap 22 and the spring seat 27 in the vacuum chamber 24 to urge the diaphragm 23 and latch pin 26 constantly in the downward direction in the drawing.

Thus, the engaging means in this embodiment is constituted by the stepped large diameter portion 17A of the plunger fitting bore 17, the ball fitting holes 19 formed in the large diameter portion 18A of the plunger 18, the latch pin 26 secured to the diaphragm 23 and received in the large diameter portion 18A, and balls 20 fitted in the ball holes 19 and engaged inbetween the stepped large diameter portion 17A and tapered surface 26A of the latch pin 26.

Designated at 29 is a valve seat ring which is fitted in an inner portion of the fuel outlet 4 of the nozzle body 1, and at 30 is a spout connector which is fitted in the fuel outlet 4 in a position in front of the valve seat ring 4, the spout connector 30 being securely fixed to the nozzle body 1 by a screw 31. The spout connector 30 has the spout pipe 5 threaded thereinto, and slidably receives in its valve support portion 30A an auxiliary valve 32 which is pushed into a valve opening position by the liquid pressure. The auxiliary valve 32 is constantly urged to seat on the valve seat ring 29 by a spring 33 which is charged between the spout connector 30 and the auxiliary valve 32. A retainer ring or the like may be used instead of the screw 31 for fixation of the spout connector 30 if desired.

The spout tube 5 is internally provided with a liquid level detector 34 which has one end thereof opened to the outside in the vicinity of the spout end 5A of the tube to serve as a suction port 34A and the other end connected to the spout connector 30. Indicated at 35 is an air passage which is formed in the spout connector, at 36 an annular air passage which is formed between the outlet 4 of the nozzle body 1 and the spout connector 30, and at 37 an air passage which is formed in the nozzle body 1 and cap 22 in communication with the vacuum chamber 24. The vacuum chamber 24 is in turn communicated with the spout end 5A through the respective air passages 37, 36 and 35 and the liquid level detector tube 34. Further, denoted at 38 are air induction passages which are formed in the valve seat ring 29 and which have one end thereof connected to the air passage 37 and the other end opened into the fuel passage of the valve seat ring 29. Accordingly, when the auxiliary valve 32 is opened as a result of opening of the valve 7, the annular air passage between the valve seat ring 29 and auxiliary valve 32 forms a choke passage, producing vacuum in the air induction passage 38 by venturi effect and tending to suck the air in the vacuum chamber 24. However, before the liquid in the tank reaches a predetermined level, atmospheric air is sucked through the liquid level detector tube 34 and air passages 35 and 36 without producing vacuum in the vacuum chamber 24. If the air suction port 34A in the liquid level detector tube 34 is closed by replenishment of the fuel to a predetermined amount, air in the vacuum chamber 24 is sucked to produce vacuum therein and the diaphragm 23 is moved upward in the drawing against the action of the spring 28 by the pressure differential from the atmospheric chamber 25. As a result, the latch pin 26 is moved upward, releasing the plunger 18 with which the latch pin 26 has been in engagement through the balls 20 and permitting the plunger 18 to move downward by the action of the valve spring 11.

The reference numeral 39 denotes an operating lever which is employed in the present embodiment, which is formed in U-shape in cross section including side plates 39A and 39B and a bottom plate 39C and provided with a slit 39D for passing a leaf spring 47. The operating lever 39 has one end thereof pivotally supported on the lever connecting end 18B of the plunger 18 through a pin 40 and has the bottom plate 39C abutted against the other end of the valve stem 12 at an intermediate portion, forming at the other end a handle to be gripped by an operator. A lever guard 41 consisting of a frame of U-shape is attached to the nozzle body 1 by guard pins 42 and 43 in a manner to circumvent the operating lever 39.

Indicated at 44 is an angular slide rack which is provided with spaced parallel side plates 44A and 44B and a bottom plate 44C in a fore end section, converging bent side plates 44D and 44E in an intermediate section, and joined parallel side walls 44F and 44G in a rear section with rack portions 44H at three different positions on the upper side thereof. The slide rack 44 has its one end pivotally supported on the plunger 18 through the afore-mentioned pin 40 coaxially with the operating lever 39. In this instance, the side plates 44A and 44B are disposed to embrace the side plates 39A and 39B of the operating lever 39, while the angularly bent side plates 44D, 44E, 44F and 44G are extended along the inner side 41A of the lever guard 41.

Designated at 45 is a trigger which is formed in U-shape in cross section, having straight side plates 45A and 45B and a bottom plate 45C. The bottom plate 45C is provided with a projection 45D on the upper side thereof, which is engageable with the bottom plate 39C of the operating lever 39 to determine the position of the trigger 45. The trigger 45 has its one end pivotally connected to an intermediate portion of the operating lever 39 through a pin 46, and the other end extended toward the slide rack 44 and releasably engaged with a rack portion 44H.

The reference numeral 47 indicates a releasing leaf spring which consists of a slide rack biasing section 47A which is extended on and along the bottom plate 44C of the slide rack 44 for slidably urging the lower sides of the respective side plates 44D, 44E, 44F, 44G of the slide rack 44 toward the inner side 41A of the lever guard 41, a bent section 47B which is at one end of the slide rack onto one end of the bottom plate 39C of the operating lever 39, an intermediate spring section 47C which is extended from the bent section 47B at one end of the bottom plate 39C of the operating lever 39 toward an intermediate portion through the slit 39D, and a trigger biasing section 47D which is projected from the slit 39D and extended along the bottom plate 45C of the trigger 45 to urge the trigger 45 in a direction away from the rack portion 44H of the slide rack 44. The valve stem 12 is in contact with the upper side of the intermediate spring section 47C of the leaf spring 47, pressing the latter on the bottom plate 39C of the operating lever 39. The reference numeral 48 denotes a fender guard of a synthetic resin.

The fuel dispensing nozzle with the above-described construction is operated in the following manner.

Before starting a fuel supply, the main valve body 8 and auxiliary valve body 9 which constitute the valve 7 are both held in closed position by the spring 11, the plunger 18 is engaged with the latch pin 26 through the balls 20, and the trigger 45 is kept away from the slide rack 44 by the spring 47, the nozzle as a whole assuming the position of FIG. 1.

In order to start an automatic shut-off fuel supply operation, the handle of the operating lever 39 is gripped by a hand and pulled up, turning the lever 39 about the pin 40 to lift up the valve stem 12. As a result, the valve 7 is opened against the action of the valve spring 11. More particularly, since the valve 7 is constituted by the main valve body 8 and auxiliary valve body 9 in the particular embodiment shown, the auxiliary valve body 8 which is secured to the valve stem 12 is firstly unseated from the valve seat portion 8B upon lifting up the valve stem 12, permitting a small amount of fuel to flow through the fuel passage 8A to reduce the pressure differential across the main valve body 8. As soon as the stroke of the valve stem 12 exceeds the small gap S, the washer 13 urges the main valve body 8 to unseat from the valve seat 6, opening the fuel passage 2. Thus, in the present embodiment, the auxiliary valve body 9 is opened in advance to reduce the pressure differential across the main valve body 8 to a minimum before opening the valve 8, so that the valve body 7 can be opened only against the action of the valve spring 11 and the valve operating force can be reduced to a significant degree.

Figure 3:
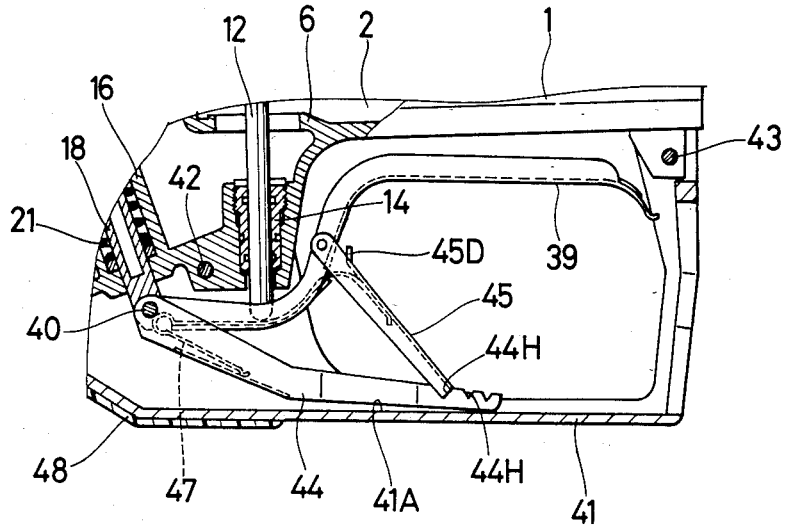
FIG. 3 is a schematic view of the nozzle in an automatic shut-off fuel dispensing operation.

After pulling up the operating lever 39, the trigger 45 is turned clockwise about the pin 46 against the spring force of the trigger biasing section 47D of the leaf spring 47 to engage the fore end portion of the trigger 45 in the rack portion 44H of the slide rack 44. By so doing, the operating lever 39 is retained in the position of FIG. 3.

On the other hand, upon opening the valve body 7, the fuel from the gasoline meter flows into the fuel passage 2 and opens the auxiliary valve 32 by the liquid pressure against the action of the spring 33, feeding the fuel from the spout end 4 into a vehicular fuel tank or the like through the spout tube 5. At this time, the gap space between the valve seat ring 29 and the auxiliary valve 32 forms a choke passage which creates a vacuum state by venturi effect and sucks air from the air induction passage 38. If the air induction passage 38 is sucked in this manner, it tends to draw air from the vacuum chamber 24 through the air passage 37. However, since it is in communication with the liquid level detector tube 34 through air passages 35 and 36, atmospheric air is sucked through the liquid level detector tube 34 without creating a vacuum state in the vacuum chamber 24.

If the liquid level in the fuel tank is elevated until the air suction port 34A of the liquid level detector tube 34 is closed, air in the vacuum chamber 24 is sucked since no air is introduced through the air suction port 34A any longer. As the vacuum chamber 24 reaches a predetermined vacuum level, the diaphragm 23 is moved upward in the drawing against the action of the spring 28 due to a pressure differential from the atmospheric chamber 25, lifting up the latch pin 26. Consequently, the balls 20 are relieved of the pressing force which has been imposed thereto by the tapered portion 26A of the latch pin 26, releasing the plunger 18, which is retained between the latch pin 26 and the plunger receiving bore 17, to permit its downward movement.

Figure 4:
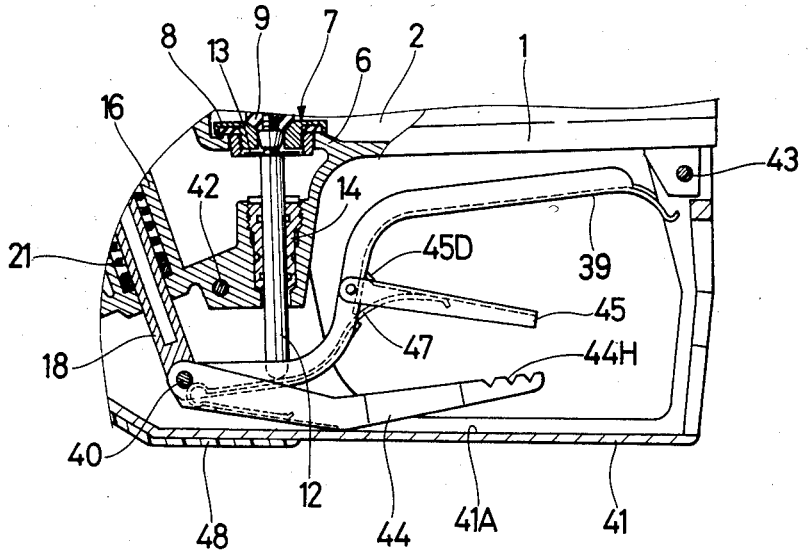
FIG. 4 is a view similar to FIG. 3 but showing the nozzle immediately after automatic shut-off.

In this instance, the spring force of the plunger return spring 21 which urges the plunger 18 upward is far smaller than the spring force of the valve spring 11 and further the valve spring 11 urges the valve stem 12 in the downward direction in the drawing, so that the operating lever 39 which is held in the valve open position by the trigger 45 is turned counterclockwise about the pin 46, which is a pivotal connection to the trigger 45, pulling down the plunger 18 into the second position shown in FIG. 4.

As a result of this accompanying downward sliding movement of the plunger 18, one end of the slide rack 44 which is pivotally connected to the lower end of the plunger 18 by the pin 40 is simultaneously moved downward, and the other end of the slide rack 44 is slided to the right in the drawing along the inner surface 41A of the lever guard 41.

Accordingly, the trigger 45 which has been in engagement with the rack portion 44H of the slide rack 44 is caused to lose its supporting function or engaging force by the sliding movement of the slide rack 44, and turned upward in the drawing by the action of the trigger biasing section 47D of the leaf spring 47. As a result, the trigger 45 is disengaged from the rack portion 44H to assume the position of FIG. 4.

Further, as the fuel dispensing nozzle is removed from the fuel tank, atmospheric air is sucked in through the air suction port 34A of the liquid level detector tube 34 to equalize the pressure in the vacuum chamber 24 with the atmospheric chamber 25, protruding the latch pin 26 into the large diameter portion 18A of the plunger 18. On the other hand, the plunger 18 is lifted up by the plunger return spring 21 with the balls 20 located between the tapered portion 26A of the latch pin 26 and the stepped large diameter portion 17A to hold the plunger 18 again in the first position, restoring the state of FIG. 1.

In the case of an ordinary fuel supply without the automatic shut-off, the operating lever 39 is continuedly gripped by an operator. In this instance, the trigger 45 is kept off the operating lever 39 by the projection 45D abutting against an intermediate portion of the operating lever 39, so that there is no possibility of the trigger 45 barring the handling of the operating lever 39.

Although the valve body 7 is constituted by the main and auxiliary valve members 8 and 9 in the above-described embodiment to minimize the force which is required for opening the valve, it is possible to eliminate the auxiliary valve member 9 by employing a single poppet valve for the valve 7.

Further, although the foregoing embodiment employs, as a trigger release spring, a leaf spring 47 consisting of a slide rack biasing section 47A, a bent section 47B, an intermediate spring section 47C and a trigger biasing section 47D, it may be omitted if desired. Alternatively, it may be substituted by a different spring, for example, a toggle spring which is arranged to urge the trigger 45 alone in the releasing direction. In the case of a toggle spring, its coil portion of the spring is mounted on the pin 46, and its one end is passed through the bottom plate 39C of the operating lever 39 and abutted on the lower side of the bottom plate 45C of the trigger 45 while abutting the other end of the spring on the lower side of the bottom plate 39C of the operating lever 39 through the slit 39D. Moreover, the slide rack biasing section 47A of the leaf spring 47, which urges the slide rack 44 toward the inner side of the lever guide 41 to facilitate the release of the trigger 45, may be substituted by another toggle spring which is mounted on the pin 40.

Furthermore, although the diaphragm 23 which is mounted on the upper side of the plunger 18 in the particular embodiment shown, there may be employed an automatic shut-off mechanism of the type which incorporates a diaphragm on a lateral side of the plunger.

An advantage of this invention is that the automatic shut-off fuel dispensing nozzle which is arranged to release the trigger by the sliding movement of the slide rack can disengage the trigger more securely as compared with the conventional counterparts. Another advantage of this invention is that the number of component parts can be reduced by the use of an operating lever which consists of a single part. Further advantages of this invention is that the provision of a slide rack in contrast to the conventional nozzles with a rack securely mounted on a lever guard, can contribute to the improvements of the machining and assembling efficiencies as well as to the reduction of the production cost.

Although the invention has been described and shown by way of a preferred embodiment, it is to be understood that various alterations and modification can be added thereto without departing from the basic concept of the invention.

What is claimed is:

1. An automatic shut-off type fuel dispensing nozzle, comprising in combination:

a nozzle body internally defining a fuel passage and having a spout tube at the outlet of said fuel passage;

a valve body liftably seated on a valve seat formed in said nozzle body for opening and closing said fuel passage;

a valve spring for urging said valve body toward a valve closing direction;

a valve stem having a first end thereof secured to said valve body and a second end protruded out of said nozzle body;

a plunger slidably received in said nozzle body;

a partition member and measn for moving said partition member in a predetermined direction when a fuel supplied from said spout tube reaches a predetermined liquid level;

an engaging means for engaging a first end of said plunger with said partition member, for holding said plunger in a first position until said predetermined liquid level is reached, and for releasing said plunger upon movement of said partition member to permit said plunger to slide into a second position;

an operating lever having a first end thereof pivotally supported on a second end of said plunger, being abutted against said second end of said valve stem in an intermediate portion of said operating lever, and forming a handle at a second end thereof;

a lever guard provided on said nozzle body in a manner to underlie said operating lever;

a slide rack having a first end thereof pivotally connected to said second end of said plunger, a second end of said slide rack comprising a rack portion slidably supported on an inner surface of said lever guard; and a trigger pivotally supported on said intermediate portion of said operating lever and comprising means for releasably engaging said rack portion of said slide rack.

2. An automatic shut-off type fuel dispensing nozzle as set forth in claim 1, wherein said valve body comprises a main valve body liftably seated on a valve seat provided in said nozzle body and an auxiliary valve body disengageably seated on said main valve body, said dispensing nozzle further comprising means for opening said auxiliary valve body in advance of said main valve body when said valve stem is lifted to open said main and auxiliary valve bodies.

3. An automatic shut-off type fuel dispensing nozzle as set forth in claim 1, further comprising a release spring urging said trigger in a direction away from said rack portion of said slide rack.

4. An automatic shut-off type fuel dispensing nozzle as set forth in claim 3, wherein said trigger comprises projection means for abutting against said operating lever when said trigger is disengaged from said rack portion of said slide rack by said release spring.

5. An automatic shutt-off type fuel dispensing nozzle as set forth in claim 3, wherein said release spring comprises a leaf spring having a trigger biasing section for urging said trigger in a direction away from said rack portion of said slide rack, and a slide rack biasing section for urging said slide rack toward inner surface of said lever guard.

6. An automatic shut-off type fuel dispensing nozzle as set forth in claim 1, wherein said trigger comprises projection means for abutting against said operating lever when said trigger is disengaged from said rack portion of said slide rack.

* * * * *